United States Patent [19]

Ballard

[11] Patent Number: 4,924,201

[45] Date of Patent: May 8, 1990

[54] CORE AND COIL ASSEMBLY FOR A TRANSFORMER HAVING AN AMORPHOUS STEEL CORE

[75] Inventor: Donald E. Ballard, Conover, N.C.

[73] Assignee: General Electric Company, King of Prussia, Pa.

[21] Appl. No.: 296,620

[22] Filed: Jan. 13, 1989

Related U.S. Application Data

[62] Division of Ser. No. 237,378, Aug. 29, 1988, Pat. No. 4,847,987.

[51] Int. Cl.[5] ..... H01F 27/24

[52] U.S. Cl. ..... 336/210; 336/212; 336/213; 336/219; 336/234

[58] Field of Search ..... 336/233, 234, 219, 213, 336/221, 225, 227, 211, 210; 29/605, 606, 609

[56] References Cited

U.S. PATENT DOCUMENTS

| | | | |
|---|---|---|---|
| 3,497,949 | 3/1970 | Salt | 336/234 X |
| 4,241,324 | 12/1980 | Douglass et al. | 336/234 X |
| 4,592,133 | 6/1986 | Grimes | 336/605 |
| 4,621,248 | 11/1986 | Shigeta et al. | 336/234 X |
| 4,724,592 | 2/1988 | Hunt et al. | 336/234 X |

*Primary Examiner*—Thomas J. Kozma

*Attorney, Agent, or Firm*—Henry J. Policinski; William Freedman

[57] ABSTRACT

This amorphous steel core transformer comprises: (i) a coil subassembly having a coil window of generally rectangular cross-section bounded by two end faces and two side faces, at least one of the side faces being slightly concave, and (ii) a core having a leg that fits within the coil window and comprises superposed aligned strips of amorphous steel stacked in the direction of the leg thickness and between said side faces. Each strip has two edges and, disposed between the two edges, a width that approximates the distance between the end faces of the coil window. The strips are further characterized by a slightly greater thickness in their central region than in the region of their edges. The core leg has a thickness that is substantially less in both edge regions of the strips than in the central region of the strips, thus rendering the leg capable of fitting more tightly within said coil window.

10 Claims, 2 Drawing Sheets

CORE AND COIL ASSEMBLY FOR A TRANSFORMER HAVING AN AMORPHOUS STEEL CORE

This is a division of application Ser. No. 237,378, filed August 29, 1988, now U.S. Pat. No. 4,847,987.

This invention relates to a core and coil assembly for an amorphous metal transformer.

BACKGROUND

The type of transformer that I am concerned with is typified by the transformer disclosed in U.S. Pat. No. 4,734,975—Ballard and Klappert, assigned to the assignee of the present invention, which patent is incorporated by reference in the present application. This transformer comprises a core made up from a plurality of thin strips of amorphous steel and preformed coil subassemblies respectively surrounding the legs of the core. Each of the preformed coil subassemblies in such a transformer is typically made by winding insulation-covered wire about a hollow form of electrical insulating material. The internal surface of this hollow form defines a generally rectangular coil window that surrounds the associated leg of the core. This window is bounded by two spaced-apart generally parallel end walls and two spaced-apart sidewalls.

The above-described coil window is not exactly rectangular in cross-section. Typically, the internal surfaces of its sidewalls are slightly concave and its corners are rounded or have a bevel (for reasons associated with the manufacture of the preformed coil assembly). These departures from an exact rectangular form make it difficult to make highly efficient use of the window cross-section for receiving the core leg, particularly if the core leg has a rectangular cross-sectional periphery intended to closely fit the coil window. The concave internal surfaces of the sidewalls create wasted space between the coil window and such a core leg, and the rounded or beveled corners tend to interfere with ideal positioning of the corners of the core leg.

OBJECTS

An object of the present invention is to make more efficient use of such a coil window, particularly in a transformer where the surrounded core leg is made of amorphous steel strips stacked in a direction extending between the side walls of such a coil window and having a width extending between the end walls of such a coil window.

Another object is to provide a core and coil assembly comprising a core contrus in such a manner that the core leg of the immediately-preceding object has a cross-sectional configuration that more closely conforms to the cross-sectional configuration of the coil window.

One step in the manufacture of an amorphous steel core of the above-described type is an annealing operation in which the core is baked at an appropriate temperature to relieve the residual stresses therein resulting from prior fabricating steps. Such annealing operation is carried out before the core leg is inserted into the coil window.

Another object of my invention is to provide a core made by applying clamping forces to the core during annealing in such a manner that the cross-sectional configuration of the core leg after annealing more closely conforms to the cross-sectional configuration of the coil window in which the core leg is later received.

SUMMARY

In carrying out the invention in one form, I provide a core and coil assembly for an amorphous steel core transformer. Comprising a coil subassembly having a window of generally, but not exactly, rectangular cross-section. The coil window is bounded by two spaced-apart generally parallel end faces and two spaced-apart slightly concave side faces. I also provide a core having a leg that comprises many superposed substantially-aligned strips of amorphous steel, each strip having two edges spaced apart by the width of the strip and a central region disposed centrally of the two edges. The width of the strip approximates the distance between the coil-window end faces. The strips are characterized by a slightly greater thickness in their central region than in the regions of the edges. Before mating the core with the coil subassembly, I anneal the core by baking it at a temperature that relieves the residual stresses therein and then slowly cooling it. During annealing, I squeeze the core leg by applying to the leg in both edge regions of the strips squeezing forces that reduce the thickness of the leg in these edge regions as compared to the thicknesses prior to squeezing and thereby render the cross-sectional shape of the core leg more conformant with the cross-sectional shape of the coil window. After this annealing and squeezing, I insert the core leg into the coil window with the thickness of the core leg extending between said slightly-concave side faces of the of the coil window.

BRIEF DESCRIPTION OF DRAWINGS

For a better understanding of the invention, references may be had to the following description taken in conjunction with the accompanying drawings, wherein:

FIG. 3 is an enlarged schematic showing of some of the laminations of which the core of FIG. 1 is made.

DETAILED DESCRIPTION OF PREFERRED EMBODIMENT

Figure 1:
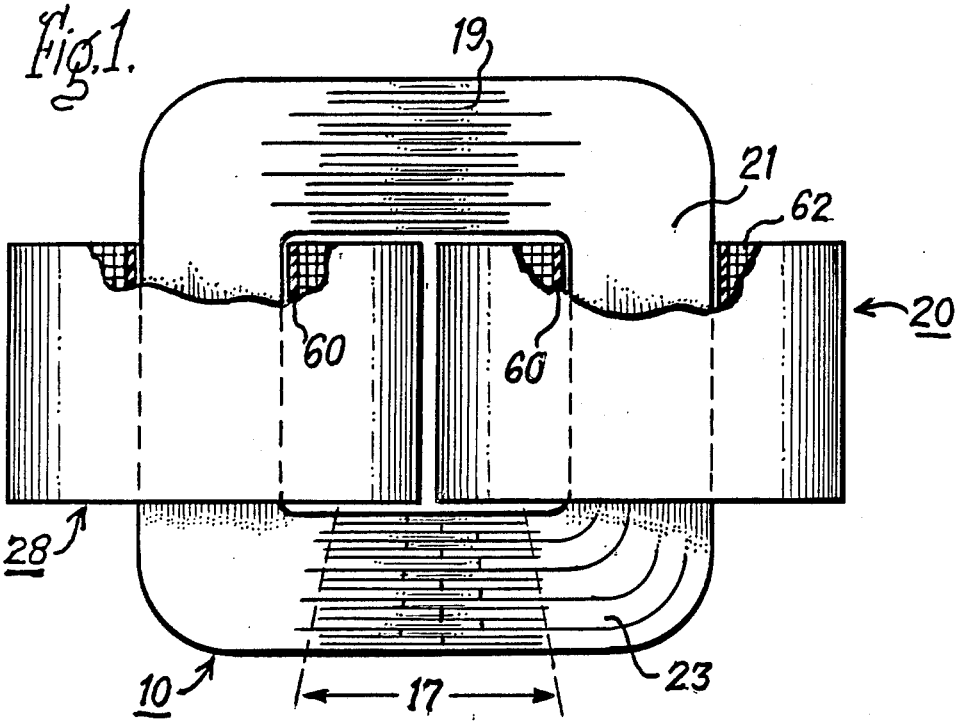
FIG. 1 is a side elevational view, partially sectional, of a transformer embodying one form of the invention. The core of the transformer is shown in cross-section and the coil subassemblies are shown partially in cross-section.

Referring now to FIG. 1, the core and coil assembly shown therein comprises an amorphous steel core 10 of closed-loop form comprising a pair of spaced-apart vertically-extending legs 21 and two horizontally-extending yokes 19 and 23 interconnecting the legs at their upper and lower ends, respectively. Two coil subassemblies 28 respectively surround the two core legs 21.

The core is made up from strip material of amorphous steel, e.g., the amorphous steel available from Allied-Signal Corp. as its Metglas 2605-S2 amorphous steel. As disclosed in the aforesaid U.S. Pat. No. 4,734,975, and referring to FIGS. 1 and 1A thereof, this strip material can be made into a core by rolling it into an annular form 4, cutting the annular form in a radial direction to form a stack of laminations 12, and then wrapping, or nesting, the laminations in groups about a mandrel to form an annulus 10 with step-lap joints 16. Another way of producing the laminations for the latter annulus is to cut the laminations from flat strip material, cutting the strip material at the proper locations to provide laminations of appropriate length.

Each lamination of the amorphous metal is very thin, nominally only about one mil in thickness, as compared to the usual 7 to 12 mil thickness of typical silicon steel laminations for distribution transformer cores. Accordingly, it is desirable to handle the laminations in groups, preferably having a thickness equivalent to one or two of such silicon steel laminations. Handling the laminations in groups, instead of individually, substantially contributes to manufacturing economy.

Still referring to FIG. 1A of U.S. Pat. No. 4,734,975, after the core laminations have been properly nested into an annulus, a first foundation strip or partial turn 18 is flexed into a semi-circle and fitted into the cylindrical window 20 of the annulus. A second foundation strip or partial turn 22 is similarly fitted into window 20 in lapped relation with strip 18. These foundation strips, which may be of conventional silicon-steel core steel, are of sufficient thickness, e.g., seven mils, and resiliency to provide underlying mechanical support for the core laminations 12 which have little strength to resist collapse of the core. Since these amorphous metal laminations are also quite brittle, these foundation partial turns further serve as protection against chipping and fracturing during the succeeding manufacturing steps and while in service. To provide overlying support for the core laminations 12, an outer locking turn 24, which again may be a strip of seven mil core steel, is provided to contain the annular shape of nested core 10 seen in FIG. 1A of the patent. The underlapped end of the locking turn is formed with a tab 24*a* which is brought out through a locking slot 24*b* in the overlapped end thereof and bent back to secure the locking turn in embracing relation about the nested core.

After the annular form 10 of FIG. 1A of the patent has been constructed as above described, it is placed on two suitable forming elements (shown at 94 in FIG. 4 of this application) that extend through its window 20. These forming elements are then forced apart to shape the form 10 into the rectangular configuration shown in FIG. 2 of the patent. Prior to this shaping step, foundation turn 22 of patent FIG. 1A is replaced with a non-lapping shorter one 22*a*. These thicker foundation partial turns 18 and 22*a* are seen to be transformed during the shaping step to the U-shaped configurations of FIG. 2. One function of these foundation turns is to impart a sufficiently large bend radius at the right angle corners 20*a* of the now rectangular core window 20 about which the relatively brittle amorphous metal laminations 12 must conform, thus significantly reducing the possibility of fracture. Also these foundation partial turns serve as buffer layers effective in preventing damage particularly to the innermost core lamination turn as the core is engaged by forming elements during the core shaping step. The outer locking turn 24, which remains in embracing relation with core 10 during the shaping procedure, also serves as a buffer layer for protecting the outermost core laminations.

Figure 2:
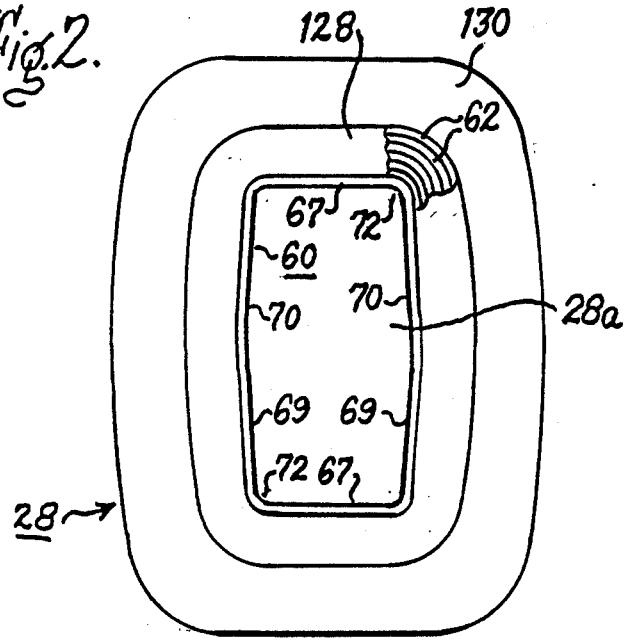
FIG. 2 is an end view, partially sectional, of one of the coil subassemblies of FIG. 1.

After the core has been shaped into the rectangular form of FIG. 2 of the patent, annealing plates (best shown in application FIGS. 4 and 5, and soon to be described) are attached to the core adjacent the outer and inner surfaces of each core leg, following which the core is annealed in a magnetic field in a suitable annealing oven. The annealing acts in a well-known manner to relieve residual stresses in the amorphous metal laminations, including those imparted during the cutting, nesting, and shaping or forming steps. When annealing has been completed, the annealing plates, referred to above, are removed, but only after an edge-bonding operation, soon to be described. During annealing, the core is heated to a temperature sufficient to relieve stresses in the amorphous metal laminations, e.g., about 360° C., but not sufficient to anneal the outer locking turn 24 or the partial turns 18 and 22*a* of the foundation layer, all of which are of a conventional core steel or the like. As part of the annealing operation, the core is kept at approximately this temperature for about 4 hours, and is thereafter slowly cooled.

Still referring to FIG. 2 of U.S. Pat. No. 4,734,975, after core 10 has been annealed, a suitable bonding agent is applied as a thin layer 26 to the exposed lateral edges of the amorphous metal laminations 12 on both sides of the core. This bonding agent is applied in liquid form, preferably by brushing, following which it dries and forms a resilient coating that bonds together the edges of the laminations. As seen in FIG. 2 of the patent, this edge bonding layer stops along lines 26*a*, which are just short of, or at the most flush with, the free ends 18*a* of foundation partial turn 18. Thus, bonding layer 26 secures the laminations 12 together as a unit along the entire length of the top yoke 19, and along a substantial portion of the length of the interconnecting legs 21, stopping just short of their corner junctions with the lower yoke 23 containing joint region 17. Thus the amorphous metal laminations 12 are effectively restrained from disorientation relative to each other, while leaving the segments of the laminations in the lower yoke 23 leading to and included in joint region 17 free to open up and accommodate the core lacing procedure described in conjunction with FIGS. 3 and 4 of U.S. Pat. No. 4,734,975. Note that foundation partial turn 22*a* is beyond the edge-bonding layer boundary lines 26*a*, and thus is free to be removed when the core is to be laced about a transformer coil. However, foundation partial turn 18 and locking turn 24 along a substantial portion of their length are edge bonded to the laminations 12. Care is taken during the application of the bonding agent to avoid penetration between the laminations as this would adversely affect core loss. Suitable edge bonding agents are SCOTCH-GRIP 826 or SCOTCH-CLAD EC 776, both available from the 3M Company.

After the above-described edge-bonding has been effected, the outer locking turn 24 (FIG. 2 of the patent) is unlocked by straightening tab 24*a* and releasing it from locking slot 24*b*. With the upper yoke 19 supported with legs 21 extending downwardly therefrom, the non-edge-bonded portions of the unlocked outer turn spring into the positions shown in FIG. 3 of the patent. Also, the two halves 23*a* of the lower yoke, no longer being restrained by the outer locking turn, fall into their downwardly hanging positions of patent FIG. 3, separating from each other at the joint region 17 included in the lower yoke. It is seen that edge-bonding layer 26 readily accommodates the core being opened up while restraining relative movements of laminations 12 over a substantial portion of their circumferential lengths.

To facilitate the core-lacing operation, the two halves 23*a* of the lower yoke that extend between the localized joint region 17 and the two corner regions at the ends of the lower yoke are oriented to be substantially aligned with the core legs 21 to which they are attached. As a result, the core is then of an essentially U-shaped configuration with essentially straight legs comprising the original legs 21 and the then-aligned yoke halves 23*a*. (See FIG. 3 of the patent.) The extended legs of this U-shaped structure can easily be slid through the windows 28*a* of two transformer coil assemblies 28 that are respectively adapted to encircle the original legs 21 with only slight clearance.

Figure 4:
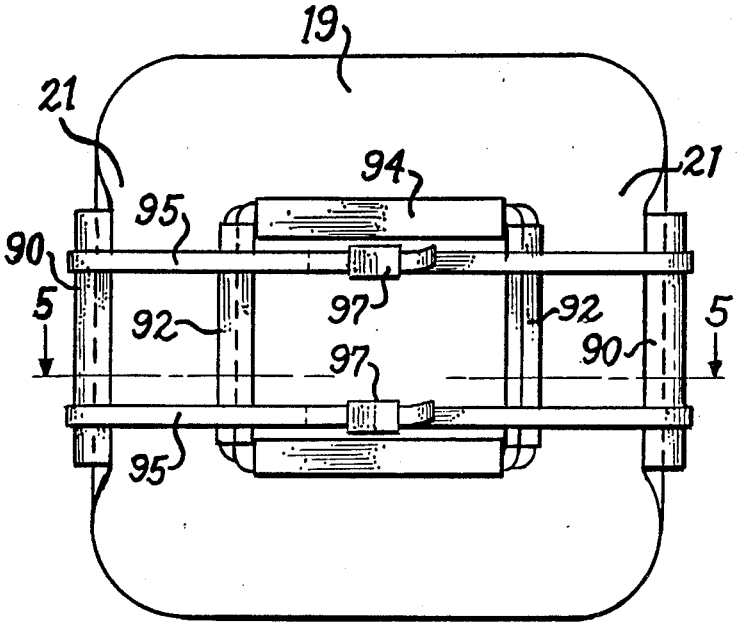
FIG. 4 is a side elevational view of the core of FIG. 1 with the hardware used for annealing shown applied thereto. For simplicity, no core laminations or joints are shown in FIG. 4.

After the extending legs of the U-shaped core structure have been inserted into the coil assemblies, the joint halves at the ends of the leg structures are dipped in a bath of light weight oil, as illustrated in FIG. 4 of the patent of sprayed with such oil. Then the joint halves are moved into positions to remake the joints and thereby reclose the core. This joint-remaking is facilitated by the oil then present on the joint halves, as is described in U.S. Pat. No. 4,734,975. Thereafter, the locking turn 24 is reclosed and the tab 24*a* resecured to hold the locking turn in embracing relation about the reclosed core. The edge-bonding layers 26 insure that laminations 12 are not disoriented as the core is reclosed, and thus the core in its completed assembly with the coil structure assumes substantially the exact same configuration it possessed at the time it was annealed. Thus virtually all of the stresses induced in the laminations during the core lacing procedure are effectively relieved.

Referring to FIG. 2 of this application, each of the coil subassemblies 28 comprises a low voltage coil 128 and a high voltage coil 130 surrounding the low voltage coil and suitably insulated therefrom. The low voltage coil 128 is made by placing a hollow form 60 of electrical insulating material on a mandrel (not shown) that fits within the hollow form. Then insulation-covered wire 62 is wound about the hollow form 60 in layers until the desired number of turns is present. Thereafter, the high voltage coil 130 is wound about the low voltage coil 128. The mandrel is then removed, and the coil assembly 28 has the appearance depicted in partial cross-section in FIG. 2. As is well known in the art, this low voltage coil can alternatively be produced by winding about the form 60 conductive strip having a thin sheet of insulation thereadjacent, both the strip and the sheet, having a width approximately equal to the height of the coil.

Figure 2A:
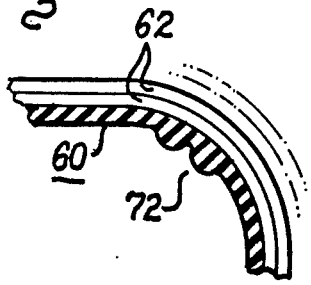

As shown in FIG. 2, the hollow insulating form 60 includes a coil window 28*a* of generally rectangular cross-sectional form. This window 28*a* is bounded by two spaced-apart generally-parallel end walls 67 and two spaced-apart sidewalls 69 having slightly concave inner faces 70. Each sidewall 69 is joined to the wall 67 thereadjacent by a corner 72. Each of these corners 72 is rounded or bevelled, a typical bevel configuration being shown in the enlarged view of FIG. 2A. In view of the bevelled, and the non-rectangular, nature of corners 72 and the slightly concave nature of faces 70, it will be apparent that the coil window 28*a* is not exactly rectangular.

It is easier to make more efficient use of the coil window cross-section for receiving the core leg if the window cross-section is exactly rectangular, particularly if the core leg has a rectangular cross section. But for practical reasons (associated with the manufacture of the coil assembly), it is difficult to provide an exactly rectangular coil window cross-section. Rounded or bevelled corners are needed to prevent an excessively sharp bend in the coil conductor, and the concave configuration of the sidewalls is needed to impart mechanical strength to the form 60.

To enable more efficient use to be made of the cross-sectional area of the coil window 28*a*, I modify the cross-sectional shape of the associated core leg 21 so that it more closely conforms to the cross-sectional shape of the coil window. To this end, I apply to the core leg during the above-described annealing operation, squeezing forces that have the effect of reducing the thickness of the core leg in the two regions of the leg that are located adjacent the two end walls 67 of the coil window.

Figure 3:
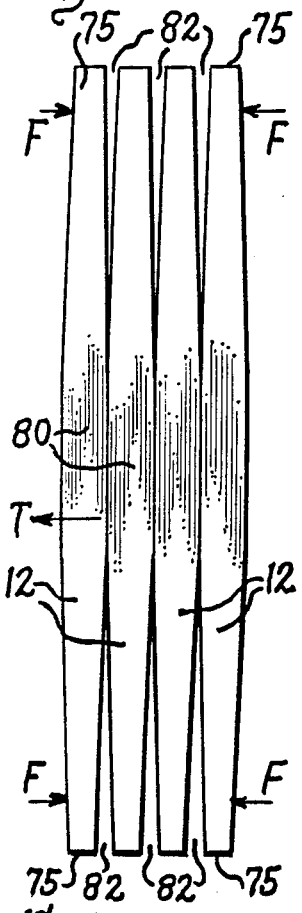
FIG. 3 is an enlarged sectional view of an inside corner region of the coil subassembly of FIG. 2.

I am able to utilize the above-described squeezing forces for effecting this reduction in the core leg thickness because the amorphous metal strip material of which the core laminations are made typically has a slightly greater thickness (e.g., 5 to 20 percent greater) in its central region than it does at its edges. This is illustrated in FIG. 3 of the application, where some of the laminations are shown exaggerated in thickness and in the above-described thickness differences and stacked in the direction T of the core leg thickness. FIG. 3 depicts these laminations before they are clamped for annealing. Since the laminations are typically slightly thinner adjacent their edges 75 than in their central regions 80, there will be very narrow spaces 82 between the laminations in the regions of their edges 75. Accordingly, if the laminations are clamped together by squeezing forces F applied in the regions adjacent the edges 75, the core leg thickness in the edge regions will be reduced by substantially the sum of the thicknesses of these narrow spaces 82.

Figure 5:
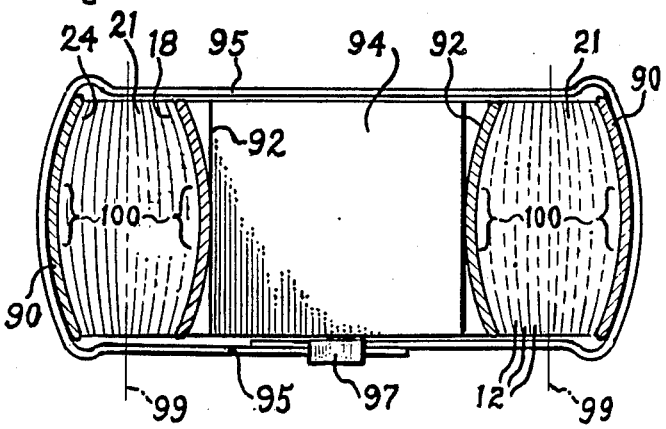
FIG. 5 is a sectional view along the line 5—5 of FIG. 4.

Referring to application FIGS. 3, 4 and 5, I am able to apply squeezing forces in the region of edges 75 by providing clamping plates 90 and 92 for each core leg that have clamping faces of concave configuration for bearing against the core leg. When the clamping plates are forced together, they will bear on the outer and inner surfaces of the core leg in the regions adjacent edges 75.

For forcing the clamping plates together, I rely upon the forming blocks 94 and a pair of steel clamping straps 95, each strap encircling the entire core. The forming blocks are left in place after the above-described forming operation that converted the core from a round to a rectangular configuration. At each end of the forming blocks, one of the inside clamping plates 92 is inserted between the inner surface of one core leg and the end of the forming block. At the outer surface of each core leg another of the clamping plates 90 is applied. The straps 95 embrace the core, extending about both legs 14 and the outer clamping plates 90, as shown in FIGS. 4 and 5.

When the straps 95 are tightened just prior to annealing of the core, the clamping plates 90 and 92 at each side of each leg are forced together, squeezing the core leg between them. During such clamping, the forming blocks 94 maintain a fixed spacing between the inside clamping plates 92. After the straps are tightened, a conventional buckle 97 on each strap 95 holds the strap in its tightened condition, thus maintaining the squeezing forces on each leg during the annealing operation that follows.

As pointed out hereinabove, the squeezing forces developed by the tightened clamping bands reduce the thickness of the core leg in the region adjacent the edges 75 of the laminations. This has the effect of bending, or bowing, the laminations of the core leg except those adjacent the medial plane 99 of FIG. 5. The amount of such bending increases, the greater the distance from this medial plane 99. The annealing operation acts to relieve any residual stresses in the amorphous metal laminations produced by such bending or bowing.

After annealing and while the clamping plates 90, 92 and the straps 95 are still in place, the above-described bonding layer 26 is applied to the exposed lateral edges 75 of the laminations 12 on both sides of the core leg. This bonding agent, when it dries, bonds together the edge regions of the laminations 12 and holds the laminations in the positions that they occupy when clamped during annealing. The clamping plates 90, 92 and the straps 95 are removed only after the bonding agent has dried and effected this bonding together of the laminations. As previously pointed out, the bonding agent also bonds to the inner foundation turn 18 and the outer locking turn 24 and thus hold these turns in a slightly bowed condition and in closely conforming engagement with the rest of the associated core leg.

Figure 6:
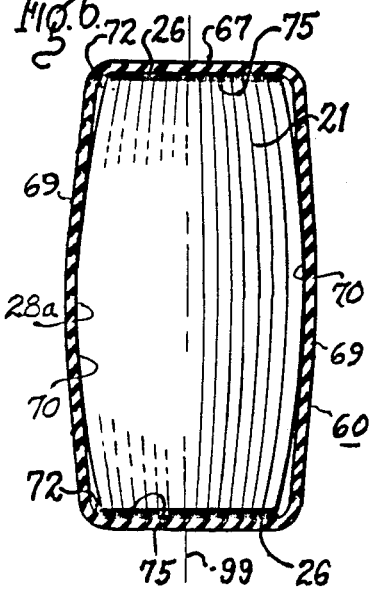
FIG. 6 is an enlarged sectional view through one of the core legs in the final assembly, also showing around the core leg the insulating member that forms the coil window.

FIG. 6 provides a schematic illustration of how the core leg 21, modified in cross section as above described, has a cross-sectional configuration that more closely conforms to the cross-sectional configuration of the coil window 28*a*. The reduced thickness of the leg at the edges 75 of the laminations enables the corner region of the core to avoid the bevels at the corner 72 of the coil window, and the bowed configuration of the outer and inner laminations enables the outer and inner surfaces of the core leg to conform more closely to the adjacent concave inner surfaces of the coil window. The edge-bonding adhesive is shown at 26 in FIG. 6.

By providing a core leg cross-sectional configuration that more closely conforms with that of the coil window, the coil window can be made smaller, which means that shorter conductors can be used for the coil conductors and less space will be occupied by the coil subassembly. These latter features lead to manufacturing economies.

While clamping plates have heretofore been utilized for clamping the legs of amorphous metal cores during annealing, insofar as I am aware these plates have been essentially flat members that typically cause the principal clamping forces to be applied to the central regions 100 of the core leg (see FIG. 5) and the central regions of the laminations 12 constituting the core leg. In some cases when such flat clamping plates were used, the clamping forces exerted through the clamping straps have drawn the plates together at their edges along one side of the core but caused them to separate at their edges along the opposite side of the core, i.e., have caused a canting of the clamping plates. Typically, the plates were drawn together at their edges located adjacent the buckles 97. The effect of such canting of the clamping plates is to make the core leg significantly thinner on one side than the other. This is undesirable because it allows the later-applied adhesive bonding agent (26) to penetrate between the laminations on the thicker side of the core, thus contributing further to the differences in core leg thickness at opposite sides of the leg. A core leg of this latter form conforms even less than a perfectly rectangular core leg to the cross-sectional shape of the coil window.

Although I prefer to use for each core leg concave clamping plates at both sides of the core leg thickness, some of the advantages of my invention can be realized if only one, preferably the outer clamping plate, is of a concave configuration, while the inner plate is of a planar configuration. My invention in its broader aspects is therefore intended to comprehend a method that uses only one such concave clamping plate, and the resulting core. Additionally, in certain transformers, the hollow form 60 of the coil subassembly in its final configuration will have one side wall (69) that is substantially planar, while the other sidewall (69) remains substantially concave as shown. In making the core for such a transformer, I use a concave clamping plate (e.g., 90 of FIG. 5) at only one side of the core leg during annealing, rendering this one side of the leg slightly convex as shown. The convex side of this leg is so located that when the leg is inserted into this coil subassembly, the convex side of the leg is adjacent the face of the form 60 that is concave, thus producing the desired close fit between the core leg and the surrounding coil form 60. In this embodiment, a substantially flat clamping plate is used during annealing for the side of the leg that is to be located adjacent the substantially planar sidewall of the form 60 of this coil subassembly.

While I have shown and described a particular embodiment of my invention, it will be obvious to those skilled in the art that various changes and modifications, such as that of the immediately-preceding paragraph, may be made without departing from the invention in its broader aspects, and I, therefore, intend herein to cover all changes and modifications as fall within the true spirit and scope of my invention.

What I claim as new and desire to secure by letters patent of the U.S. is:

1. A core and coil assembly for an amorphous metal core transformer, comprising:

(a) a coil subassembly having a coil window of generally rectangular cross-section, the coil window being bounded by two spaced-apart generally-parallel end faces and two spaced-apart side faces, at least one side face being slightly concave, the side faces each having two end regions adjacent said end faces and a central region, the central regions of the side faces being spaced apart by a slightly greater amount than the end regions, (b) a core having a leg that fits within said coil window and comprises superposed substantially-aligned strips of amorphous steel stacked in the direction of the leg thickness, each strip having two edges spaced apart by the width of the strip and a central region disposed centrally of said two edges, the width of the strips approximating the distance between said coil-window end faces, the strips being characterized by a slightly greater thickness in their central region than in the regions of their edges, said leg having a thickness that is substantially less in both edge regions of said strips than in the central region of said strips, thereby rendering said leg capable of fitting more tightly within said coil window.

2. The assembly of claim 1 in which the edges of said strips at each side of the central region of the strips are substantially aligned and bonded together with adhesive bonding material.

3. The assembly of claim 1 in which the reduced thickness of said leg in the edge regions of said strips is produced by squeezing said leg during annealing of the core leg by applying to said leg in both edge regions of the strips squeezing forces that reduce the thickness of said leg, thereby rendering said strips after annealing and squeezing substantially free of residual stresses.

4. The assembly of claim 3 in which the edges of said strips at each side of the central region of the strips are substantially aligned and bonded together with adhesive bonding material.

5. An amorphous steel core for a transformer comprising a leg that is adapted to fit closely within the window of a coil subassembly, the leg comprising:

(a) superposed strips of amorphous steel stacked in the direction of the leg thickness, each strip having two edges spaced apart by the width of the strip and a central region disposed centrally of said two edges, the strips being characterized by a slightly greater thickness in their central region than in the regions of their edges, the edge regions of adjacent strips at each side of the central region of the strips being positioned in intimate engagement with each other so that the leg has a reduced thickness at each of the edge regions as compared to the leg thickness in the central region of the strips, and (b) a layer of adhesive bonding agent on the edges of the strips at each side of said central regions for maintaining said reduced thickness of the leg at each of said edge regions.

6. The core of claim 5 in which:

(a) the leg has an inner surface and an outer surface at opposite sides of its thickness, and (b) the amorphous steel strips adjacent one of said surfaces are bowed to impart a convex form to said one surface.

7. The core of claim 6 in which a protective strip of crystalline metal having substantially the same width as said amorphous steel strips is located at said one surface and has edges substantially aligned with the edges of the amorphous steel strips and adhesively bonded to said aligned edges of the amorphous steel strips.

8. The core of claim 5 in which:

(a) the leg has an inner surface and an outer surface at opposite sides of its thickness, and (b) the amorphous steel strips adjacent each of said inner and outer surfaces are bowed to impart a convex form to each of said inner and outer surfaces.

9. The core of claim 8 in which two protective strips of crystalline metal having substantially the same width as said amorphous steel strips are located at said inner and outer surfaces, respectively, of the leg, said protective strips having edges substantially aligned with the edges of the amorphous steel strips and adhesively bonded to said aligned edges of the amorphous steel strips.

10. The core of claim 6 in which the reduced thickness of said leg in the edge regions of said strips is produced by squeezing said leg during annealing of the core leg by applying to said leg in both edge regions of the strips squeezing forces that reduce the thickness of said leg in said edge regions and render said stacked strips, after said annealing and squeezing and while adjacent strips have their edge regions in intimate engagement, substantially free of residual stress.

* * * * *

UNITED STATES PATENT AND TRADEMARK OFFICE

CERTIFICATE OF CORRECTION

PATENT NO. : 4,924,201

DATED : May 8, 1990

INVENTOR(S) : Donald E. Ballard

It is certified that error appears in the above—identified patent and that said Letters Patent is hereby corrected as shown below:

Column 1, line 53, "contrus" should read -constructed-

Column 2, line 7, " .Comprising" should read -comprising-

Column 5, line 26, "of" should read -or-

In Claim 10, line 6, "1" should read -5-

Signed and Sealed this

Twenty-sixth Day of March, 1991

*Attest:*

HARRY F. MANBECK, JR.

*Attesting Officer*

*Commissioner of Patents and Trademarks*